US007223175B2

(12) United States Patent
Otto

(10) Patent No.: US 7,223,175 B2
(45) Date of Patent: May 29, 2007

(54) EXPANDABLE BATON ADJUSTABLE TOP CAP ASSEMBLY

(76) Inventor: Kevin L. Otto, 908 Oklahoma Ave., Milwaukee, WI (US) 53215

( * ) Notice: Subject to any disclaimer, the term of this patent is extended or adjusted under 35 U.S.C. 154(b) by 0 days.

(21) Appl. No.: 11/459,207

(22) Filed: Jul. 21, 2006

(65) Prior Publication Data

US 2007/0026950 A1 Feb. 1, 2007

Related U.S. Application Data

(60) Provisional application No. 60/704,103, filed on Jul. 29, 2005.

(51) Int. Cl.
*F41B 15/02* (2006.01)

(52) U.S. Cl. ..... 463/47.7

(58) Field of Classification Search ..... 463/47.2, 463/47.7

See application file for complete search history.

(56) References Cited

U.S. PATENT DOCUMENTS 5,348,297 A * 9/1994 Parsons ..... 463/47.7
6,056,643 A 5/2000 Wilmoth, III

* cited by examiner

*Primary Examiner*—William M. Pierce
(74) *Attorney, Agent, or Firm*—Andrus, Sceales, Starke & Sawall, LLP

(57) ABSTRACT

An expandable baton having a gripping tube, a center tube and a striking tube that collapse and are retained in the collapsed position by a top cap assembly. The top cap assembly includes at least one spring retainer that engages the inner surface of the striking tube to retain the baton in its retracted position. The amount of holding force created by the spring retainer to hold the baton in its retracted position is adjustable. The top cap assembly includes an adjustment stem having a tapered portion that engages the spring retainer. Movement of the tapered portion of the adjustment stem relative to the spring retainer adjusts the holding force created by the end cap.

19 Claims, 5 Drawing Sheets

EXPANDABLE BATON ADJUSTABLE TOP CAP ASSEMBLY

CROSS REFERENCE TO RELATED APPLICATION

The present application is based on and claims priority to U.S. Provisional Patent Application No. 60/704,103 filed on Jul. 29, 2005.

FIELD OF THE INVENTION

The present invention generally relates to an adjustable top cap retainer for expandable batons or night sticks used by law enforcement personnel. More specifically, the present invention relates to a top cap retainer for a three section, telescoping baton that allows the user to selectively adjust the holding force of the top cap.

BACKGROUND OF THE INVENTION

Expandable batons have been used for many years by law enforcement officer as a convenient alternative to conventional one-piece batons or night sticks. When in the retracted position, expandable batons can be worn in a holster attached to the equipment belt of a law enforcement officer without interfering with the movement of the officer. Additionally, when retracted, the expandable baton can be somewhat concealed by the officer to reduce his or her threatening appearance when confronted with a delicate situation. When retracted, a top cap retainer prevents the expandable portions of the baton from extending out of the holster and possibly injuring the officer.

Expandable batons typically include an outer gripping tube that acts as the handle for the baton when the baton is in the extended position. One or two telescoping sections nest within the gripping tube such that the retracted length of the expandable baton is approximately ⅓ of its extended length. During use, the baton is sharply swung in an arc such that the inner telescoping sections are flung outward such that the centrifugal force generated during the swinging action overcomes the holding force created by the top cap retainer. Typically, each of the telescoping sections includes an expanded end that interacts with a tapered surface formed on the outer section to frictionally lock the baton in its extended position. When the expandable baton is not being used, the top cap contains a spring retainer which, when compressed within the smallest inner diameter section, allows the baton to be secured in a retracted position. An example of such a baton is shown in U.S. Pat. No. 6,056,643.

The spring retainer that forms part of the top cap used with expandable batons is typically a wire spring that provides a predetermined amount of holding force to hold the baton in its retracted position. If the holding force of the spring retainer needs to be increased or decreased, the user must physically distort the wire spring, which can be very difficult to accomplish without the use of tools. The user may wish to increase the holding force of the spring retainer depending upon the type of action the officer sees or the physical size of the officer. As an example, a smaller officer may wish to decrease the spring retainer holding force to allow the officer to more easily extend the baton by swinging the baton in an arc.

Therefore, it is an object of the present invention to provide a top cap retainer that allows the holding force of the spring retainer to be adjusted easily without the use of any additional tooling.

SUMMARY OF THE INVENTION

The present invention relates to a top cap retainer for use with an extendable baton. More specifically, the present invention relates to a top cap assembly for a three section, telescoping baton that allows the user to selectively adjust the holding force of the top cap assembly.

The top cap assembly includes a pair of spring retainers that each engage one of the sections of the expandable baton to retain the baton in its retracted position. Each of the spring retainers extends laterally outward from a center axis of the top cap assembly a holding distance. The top cap assembly includes an end cap that is rotatable about an engagement section to selectively adjust the holding distance the spring retainers extend from the center axis of the top cap assembly. By rotating the end cap, the user can adjust the holding force supplied by the pair of spring retainers. Thus, the user can selectively adjust the holding force of the spring retainer based upon the user's individual requirement.

As the end cap rotates, an adjustment stem moves relative to the spring retainers, causing a portion of each spring retainer to move along a tapered end portion of the adjustment stem. As the spring retainers move along the tapered portion toward the tip portion of the adjustment stem, the distance from the center line of the adjustment stem to the outermost portion of the spring retainer decreases, thereby decreasing the holding force created by the top cap assembly. Rotation of the end cap in the opposite direction allows the spring retainer to move in an opposite direction along the tapered section, thereby increasing the holding force of the spring retainer.

In accordance with the present invention, the holding force of the spring retainer can be selectively adjusted by the user without the requirement of any additional tooling. Thus, the user can selectively modify the baton to personalize the characteristics of the baton.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
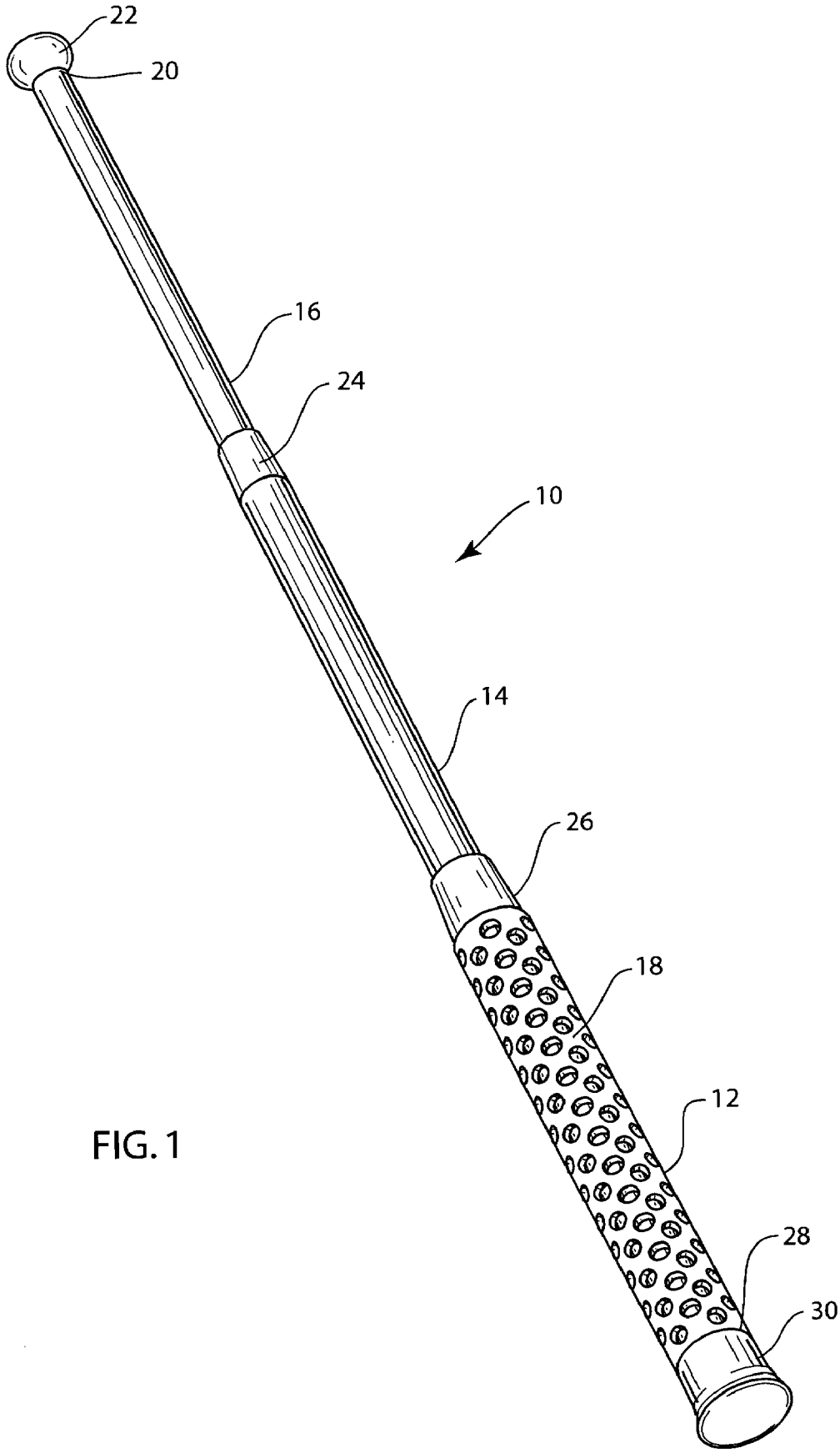
FIG. 1 is a perspective view of an expandable baton.

Referring first to FIG. 1, thereshown is the expandable baton 10 of the present invention. The baton 10 is expandable between a retracted position (not shown) and the extended, operative position shown in FIG. 1. In the preferred embodiment of the invention, the baton 10 has an overall length between twenty-one and twenty-nine inches in the extended position and has a retracted length between approximately eight and 11.5 inches, although other sizes for the baton 10 are contemplated.

The baton 10 generally includes a gripping tube 12, a center tube 14 and a striking tube 16. When the baton is in the retracted position, as shown in the partial view of FIG. 3, the center tube 14 is received within the gripping tube 12 and the striking tube 16 is received within both the center tube 14 and the gripping tube 12. As illustrated in FIG. 1, a resilient, non-slip grip member 18 is preferably adhered to the outer circumference of the gripping tube 12. The distal end 20 of the striking tube 16 includes a striking member 22 that is threadedly received on the distal end 20. The center tube 14 includes a tapered portion 24 that engages the outer surface of the striking tube 16, while the gripping tube 12 includes a similar tapered portion 26 that engages the outer surface of the center tube 14.

As illustrated in FIG. 1, the proximal end 28 of the gripping tube 12 includes a top cap assembly 30 that is threadedly received within the proximal end 28. When the baton is in the retracted position of FIG. 3, the top cap assembly 30 engages the striking tube 16 to retain the baton 10 in the retracted position.

Figure 2:
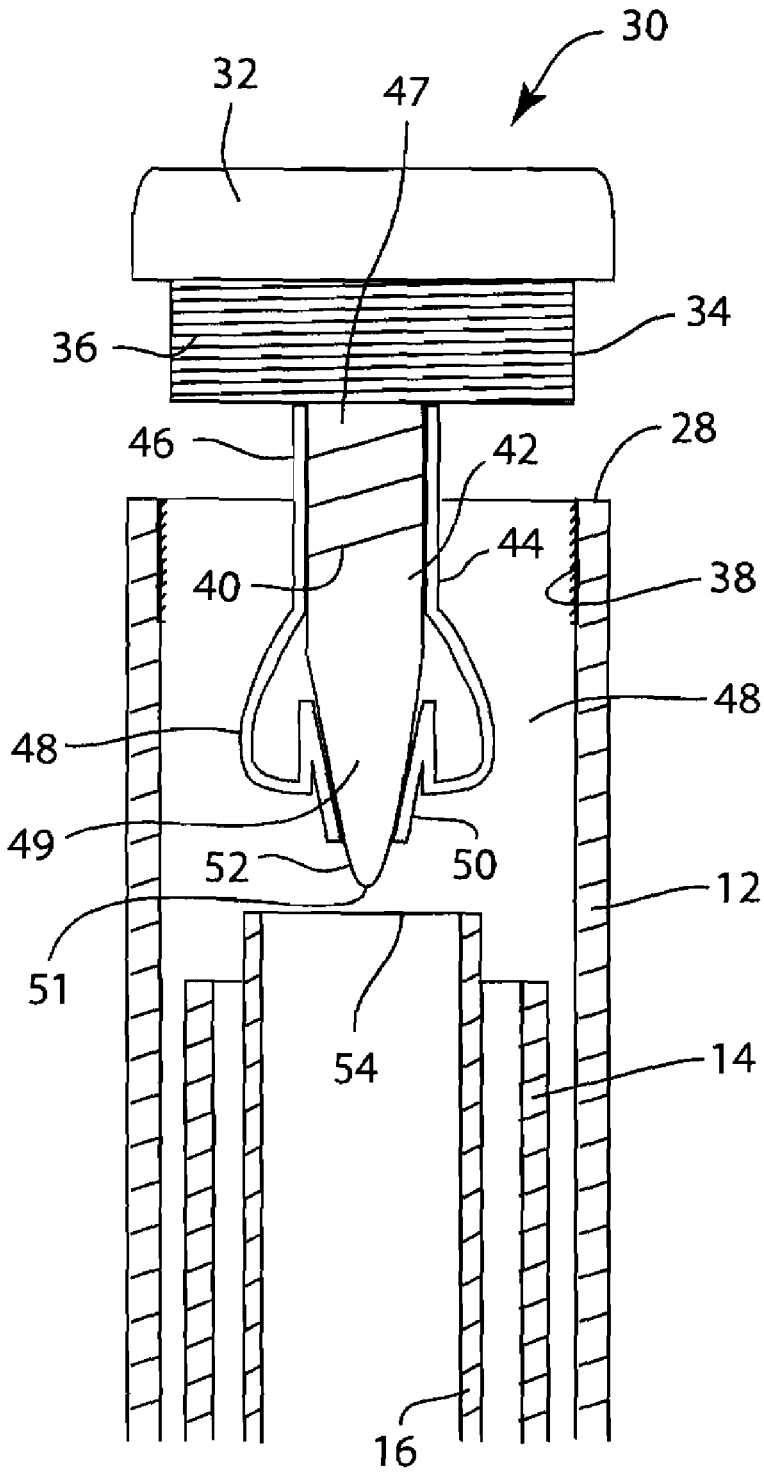
FIG. 2 is a partial section view of the adjustable top cap assembly including the spring retainer.

Referring now to FIG. 2, thereshown is the top cap assembly 30 of the present invention removed from the baton 10. The top cap assembly 30 includes an end cap 32 and a depending engagement section 34. The engagement section 34 includes external threads 36 that engage the threaded inner surface 38 of the gripping tube 12. The top cap 30 assembly further includes an adjustment stem 42 that extends past the bottom edge of the engagement section 34. In one embodiment of the invention, the adjustment stem 42 includes a series of threads 40 that interact with the end cap 32 and the engagement section 34. In the embodiment of the invention illustrated in FIG. 2, the end cap 32 is rotatable about the engagement section 34 such that as the end cap 32 rotates, the position of the adjustment stem 42 relative to the engagement section 34 is modified. Specifically, in the embodiment of the invention illustrated in FIG. 2, when the end cap 32 is rotated clockwise relative to the engagement section 34, the adjustment stem 42 is moved downward such that the length of the adjustment stem 42 extending below the engagement section 34 is increased.

As illustrated in FIG. 2, the adjustment stem 42 includes a main body 47 and a tip section 49. The tip section 49 includes a tapered outer surface 52 that reduces the outer diameter of the adjustment stem 42 from the main body 47 to the tip portion 51. In the embodiment of the invention illustrated, the entire adjustment stem 42 is formed from a molded plastic material, although it is contemplated that the adjustment stem 42 could also be formed from other durable material, such as stainless steel or aluminum.

Figure 3:
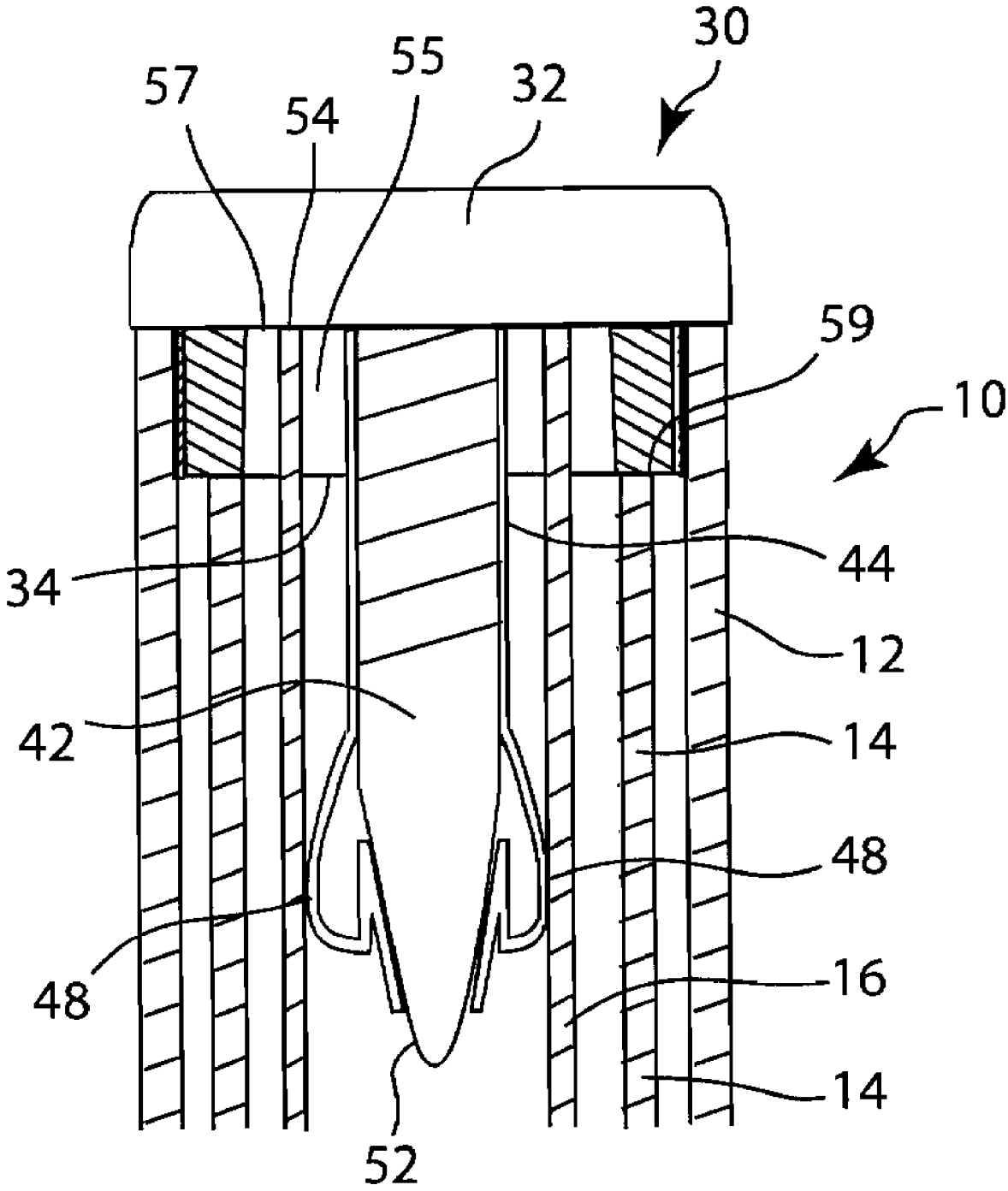
FIG. 3 is a partial section view of the expandable baton in the retracted position.

As illustrated in FIG. 2, the top cap assembly 30 further includes a pair of spring retainers 44. Each of the spring retainers 44 includes a top section 46 positioned along the body 47 of the adjustment stem 42. The top section 46 is received and retained on the end cap 32, as shown in FIG. 3. Each of the spring retainers 44 further includes an expandable, extended retaining section 48 that extends away from the outer surface of the tapered tip section 49. Each of the retaining sections 48 includes a contact leg 50 positioned in direct contact with the outer surface of the tapered portion 52 of the tip section 49. In the embodiment of the invention illustrated, each of the spring retainers 44 is formed from a flexible, thin metallic material that can deflect upon pressure being applied to the retaining section 48. Preferably, each of the spring retainers 44 is formed from a metallic material, such as steel, to enhance the durability of each of the spring retainers 44.

As illustrated in FIG. 2, the width of the retention sections 48 from the adjustment stem 42 is greater than the inner diameter of the bottom end 54 of the striking tube 16 such that the spring retainers 44 are compressed when the spring retainer 44 and adjustment stem 42 are received within the striking tube 16. Referring now to FIG. 3, when the expandable baton 10 is in its fully retracted position, the bottom end 54 of the striking tube 16 is received within the hollow interior 55 of the engagement section 34 and contacts the inner surface 57 of the end cap 32. When the striking tube 16 is fully retracted, as shown in FIG. 3, the retaining sections 48 of each of the spring retainers 44 are compressed to exert a frictional holding force against the inner walls of the striking tube 16. The amount of holding force exerted on the striking tube 16 is dependent upon the amount of compression of the retaining sections 48 when the striking tube 16 passes over the adjustment stem 42.

As further shown in FIG. 3, when the baton 10 is in the fully retracted position, the bottom end 59 of the center tube 14 contacts the engagement section 34 to prevent further movement of the center tube 14.

As discussed above, the amount of holding force exerted onto the striking tube 16 by the pair of spring retainers 44 is dependent upon the amount of compression of the retaining sections 48. In one embodiment of the invention, the adjustment stem 42 is movable along its longitudinal axis relative to the fixed top cap assembly 30 to adjust the position of the tapered portion 52 of the adjustment stem 42 relative to the stationary spring retainers 44.

Figure 4:
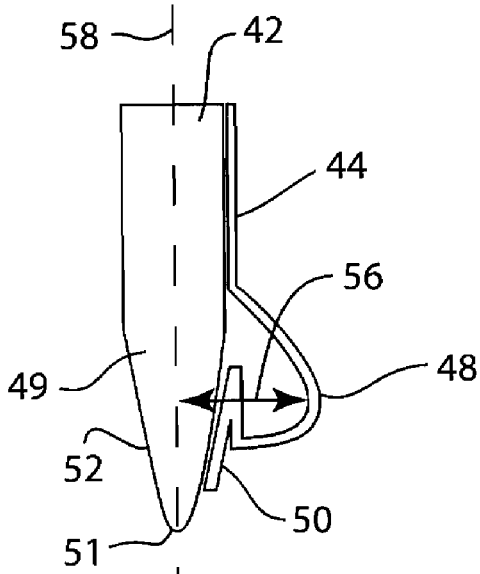
FIG. 4 is a view of the spring retainer in its maximum holding force position prior to engagement.

Referring now to FIG. 4, thereshown is the relationship between the movable adjustment stem 42 and one of the spring retainers 44. In the position shown in FIG. 4, the adjustment stem 42 is in its fully extended position at which time the spring retainer exerts its maximum holding force. When the adjustment stem 42 is in its fully extended position, the contact leg 50 of the retaining section 48 is positioned along a generally wide portion of the tip section 49 of the adjustment stem 42. In the embodiment shown in FIG. 4, the retaining section 48 extends away from the center line 58 of the adjustment stem a holding distance illustrated by reference line 56.

Figure 5:
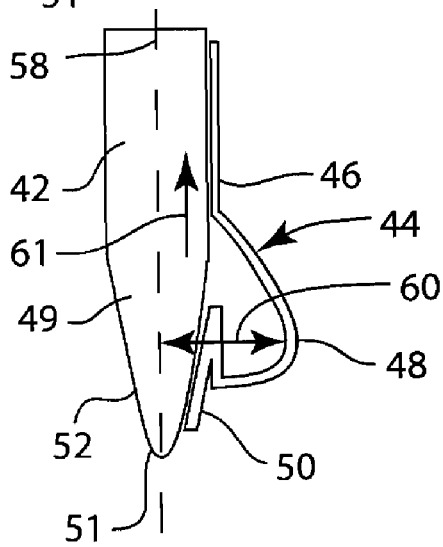
FIG. 5 is a view of the spring retainer in an intermediate holding force position.

As the end cap 32 (FIG. 2) is rotated relative to the stationary engagement section 34, the adjustment stem 42 is retracted in the direction shown by arrow 61 in FIG. 5. As the adjustment stem 42 is retracted, the contact leg 50 moves further down the outer surface 52 of the top section 49 of the adjustment stem 42 toward the tip portion 51. As the contact leg 50 moves further down the tapered tip section 49, the diameter of the tapered tip section 49 decreases. During this movement of the contact leg along the tapered tip section 49, the distance the retaining section 48 extends from the center line 58 is decreased to the distance 60 shown in FIG. 5. As can be understood by comparing FIGS. 4 and 5, the distance 60 is less than the distance 56, which thereby reduce the holding force of the spring retainer 44.

Figure 6:
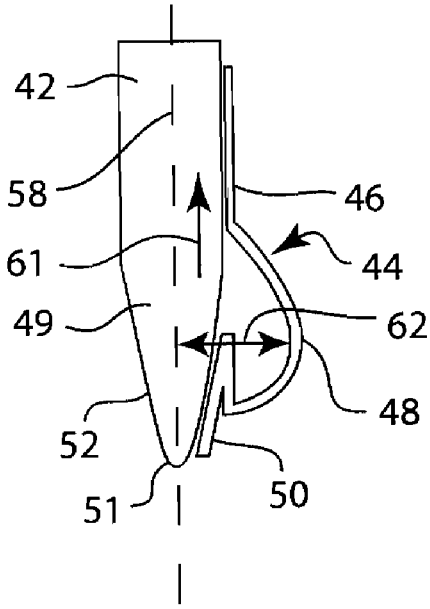
FIG. 6 is a view of the spring retainer in its minimum holding force position.

As the end cap 32 continues to rotate, the adjustment stem 42 is further retracted into the end cap, as shown by the arrow 61 in FIG. 6. As the adjustment stem 42 is retracted, the contact leg 50 moves further down the outer surface 52 toward the tip portion 51. As the adjustment stem 42 is retracted, the distance 62 that the retention section 48 extends from the center line 58 is further reduced. Thus, the holding force created by the spring retainer 44 can be adjusted by moving the adjustment stem 42 relative to the spring retainer 44. In this manner, the user can adjust the retention force created by the top cap assembly 30 by rotating the end cap 32.

Although the embodiment of the invention shown in the Figures is shown and described as including a movable adjustment stem 42 and a pair of fixed spring retainers 44, it is also contemplated that the spring retainers 44 could move relative to the fixed adjustment stem 42. In either embodiment, the movement of the contact leg 50 along the outer surface 52 of the tip section 49 controls the holding distance the retaining section 48 extends from the center line 58, thereby affecting the amount of holding force created by the top cap assembly.

In another contemplated embodiment of the invention, it is contemplated that the rotation of the end cap relative to the engagement section could include a series of detents such that the amount of rotation and adjustment in the holding force would be controlled by the individual detents. Alternatively, it is contemplated that the end cap 32 could be rotated smoothly to provide an infinite number of adjustment positions for the holding force created by the spring retainer 44.

Figure 7:
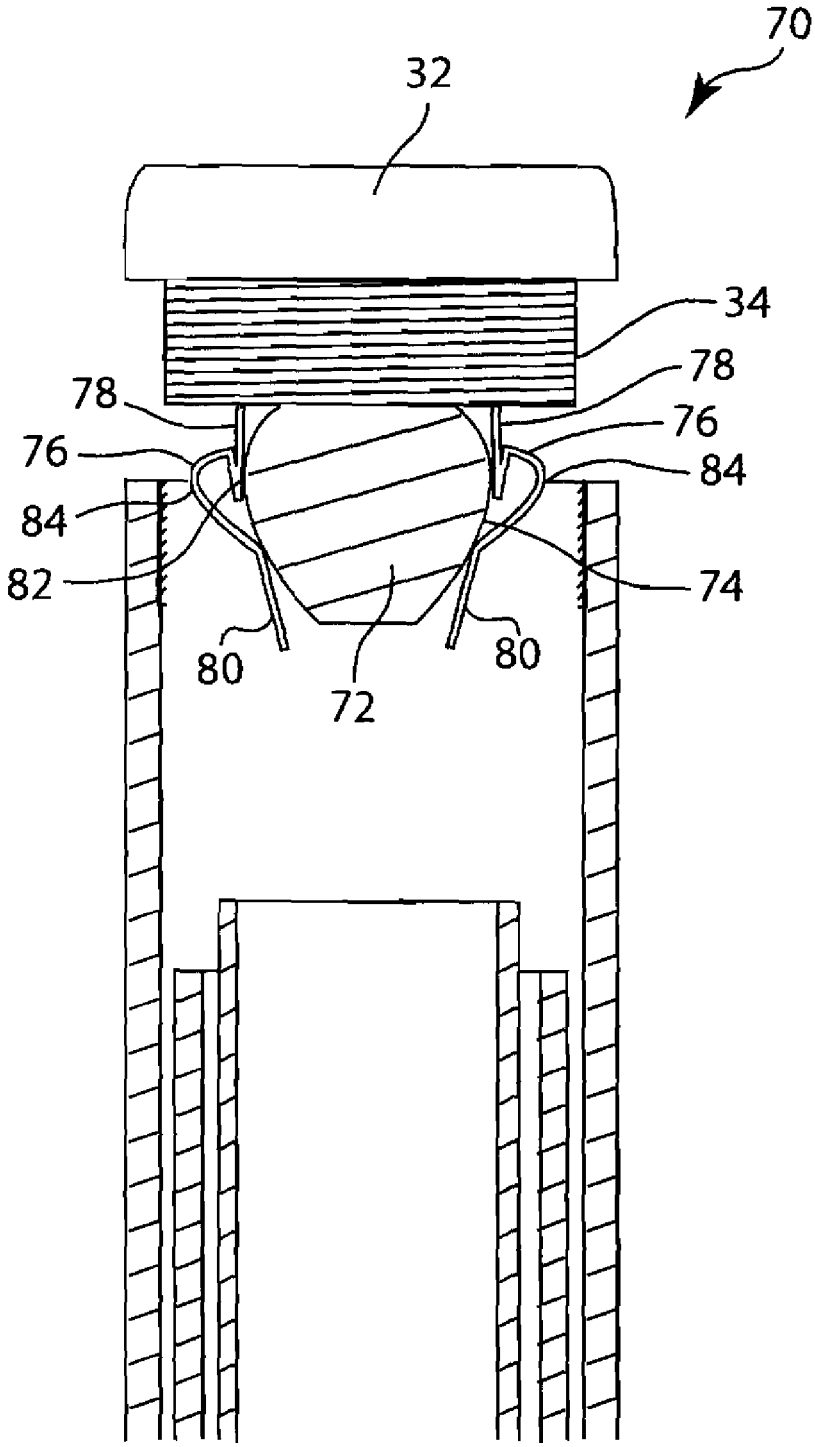
FIG. 7 is a partial section view of a second embodiment of the adjustable top cap assembly including the spring retainer.

FIG. 7 illustrates a second embodiment of a top cap assembly 70. The second embodiment of the top cap assembly 70 is similar to the first embodiment shown in FIGS. 2–6 and operates in a similar manner. In the embodiment shown in FIG. 7, the top cap assembly includes an adjustment stem 72 that extends past the bottom edge of the engagement section 34. Similar to the first embodiment, the end cap 32 is rotatable about the engagement section 34 such that as the end cap rotates, the position of the adjustment stem 72 relative to the engagement section 34 is modified. Specifically, when the end cap 32 is rotated clockwise relative to the engagement section 34, the adjustment stem 72 is moved downward such that the length of the adjustment section 42 extending below the engagement section 34 is increased.

The main body of the adjustment stem 72 includes a tapered outer surface 74 that bows outward away from the center axis of the adjustment stem 72 an exaggerated amount compared to the first embodiment shown in FIG. 1. As illustrated in FIG. 7, the top cap assembly 70 further includes a pair of spring retainers 76. The spring retainers 76 are similar to the spring retainers 48 shown in FIG. 2 except that the spring retainers 76 are inverted. Thus, the contact leg 78 of each spring retainer 76 is received within the end cap 32, while the top section 80 contacts the outer surface 74 of the adjustment stem 72.

When the end cap 32 is rotated relative to the stationary engagement section 34, the adjustment stem 72 is retracted. As the adjustment stem 72 is retracted, the contact point 82 between each of the spring retainers 76 and the outer surface 74 of the adjustment stem 76 moves to a more narrow portion of the adjustment stem 72, decreasing the distance the retaining section 84 extends away from the center line of the adjustment stem 72 and reducing the holding force of the spring retainers 76.

When the end cap 32 is rotated in the opposite direction, the contact point 82 moves to the widest portion of the adjustment stem 72 to increase the holding force created by the pair of spring retainers 76.

Like the first embodiment shown in FIGS. 2–6, the rotation of the end cap 32 increases or decreases the holding force created by the pair of spring retainers 76. In the embodiment shown in FIG. 7, the outer surface 74 of the adjustment stem 72 includes an enhanced profile to more quickly increase/decrease the holding force relative to the first embodiment shown in FIGS. 2–6.

I claim:

1. A top cap assembly for use with an expandable baton to retain the baton in a retracted position, the top cap comprising:

an engagement section receivable within the expandable baton;

an adjustment stem having a center line; and at least one spring retainer positioned in contact with the adjustment stem and having a retention section extending away from the center line a holding distance, wherein the adjustment stem and the spring retainer are movable relative to each other to modify the holding distance.

2. The top cap assembly of claim 1 wherein the adjustment stem includes a tapered portion having a decreasing outer diameter from a first end to a tip portion, the spring retainer being in contact with the tapered portion and movable along the tapered portion as the adjustable stem and the spring retainer move relative to each other.

3. The top cap assembly of claim 1 further comprising an end cap mounted to the engagement section and rotatable relative to the engagement section, wherein rotation of the end cap relative to the engagement section moves the adjustment stem and the spring retainer relative to each other.

4. The top cap of claim 3 wherein the adjustment stem is moveable relative to the spring retainer as the end cap is rotated.

5. The top cap of claim 4 wherein the spring retainer is fixed to the end cap and stationary relative to the adjustment stem.

6. The top cap of claim 3 wherein the spring retainer is movable relative to the engagement section as the end cap is rotated.

7. The top cap of claim 6 wherein the adjustment stem is fixed to the end cap and the spring retainer is movable relative to the adjustment stem.

8. A baton expandable between the retracted position and an extended position, comprising:

a gripping tube;

a center tube telescopingly slidable within the gripping tube;

a striking tube telescopically slidable within the center tube, the striking tube including a first end and a second end;

a top cap assembly received within the gripping tube and operable to retain the baton in a retracted position, the end cap comprising:

an engagement section receivable within the expandable baton;

an adjustment stem having a center line; and at least one spring retainer positioned in contact with the adjustment stem and having a retention section extending away from the center line a holding distance, wherein the adjustment stem and the spring retainer are movable relative to each other to modify the holding distance.

9. The baton of claim 8 wherein the adjustment stem includes a tapered portion having a decreasing outer diameter from a first end to a tip portion, the spring retainer being in contact with the tapered portion and movable along the tapered portion as the adjustment stem and the spring retainer move relative to each other.

10. The baton of claim 8 further comprising an end cap mounted to the engagement section and rotatable relative to the engagement section, wherein rotation of the end cap relative to the engagement section moves the adjustment stem and the spring retainer relative to each other.

11. The baton of claim 10 wherein the adjustment stem is moveable relative to the spring retainer as the end cap is rotated.

12. The baton of claim 11 wherein the spring retainer is fixed to the end cap and stationary relative to the adjustment stem.

13. The baton of claim 10 wherein the spring retainer is movable relative to the engagement section as the end cap is rotated.

14. The baton of claim 13 wherein the adjustment stem is fixed to the end cap and the spring retainer is movable relative to the adjustment stem.

15. A top cap assembly for use with a baton having a telescoping gripping tube, center tube and striking tube expandable between a retracted position and an extended position, the top cap comprising:

an engagement section threadably received within the gripping tube;

an end cap rotatably mounted on the engagement section;

an adjustment stem extending from the end cap, the adjustment stem extending along a center line and having a tapered section;

at least one spring retainer positioned in contact with the adjustment stem and having a retention section extending away from the center line by a holding distance, the spring retainer being comprised within the striking tube to exert a holding force to retain the baton in the retracted position, wherein the adjustment stem is movable relative to the spring retainer to adjust the holding distance and the holding force between the spring retainer and the striking tube.

16. The top cap of claim 15 wherein the spring retainer is movable along the tapered section of the adjustment stem.

17. The top cap of claim 15 wherein the adjustment stem is coupled to the end cap such that the adjustment stem is movable relative to the spring retainer upon rotation of the end cap.

18. The top cap of claim 15 wherein the tapered section of the adjustment stem decreases in diameter from a first end to a tip portion, wherein the spring retainer includes a contact arm movable along the tapered section of the adjustment stem.

19. The top cap of claim 15 wherein the adjustment stem is coupled to the end cap such that the adjustment stem is movable upon rotation of the end cap.

* * * * *